US005579687A

United States Patent [19]

Bielfeldt

[11] Patent Number: 5,579,687

[45] **Date of Patent: *Dec. 3, 1996**

[54] CONTINUOUSLY OPERATING PRESS FOR THE PRODUCTION OF PARTICLE BOARDS, FIBER BOARDS OR SIMILAR WOOD BOARDS AND PLASTIC BOARDS

[75] Inventor: Friedrich B. Bielfeldt, Paehl, Germany

[73] Assignee: Maschinenfabrik J. Dieffenbacher GmbH & Co., Germany

[ * ] Notice: The term of this patent shall not extend beyond the expiration date of Pat. No. 5,575,203.

[21] Appl. No.: 352,136

[22] Filed: Dec. 1, 1994

[30] Foreign Application Priority Data

Dec. 1, 1993 [DE] Germany ..... 43 40 982.2

[51] Int. Cl.[6] ..... B30B 5/06

[52] U.S. Cl. ..... 100/93 RP; 100/154; 156/583.5; 425/371

[58] Field of Search ..... 100/93 P, 93 RP, 100/151, 154; 156/583.5; 425/371

[56] References Cited

U.S. PATENT DOCUMENTS

| | | | |
|---|---|---|---|
| 2,071,999 | 2/1937 | Dike | 100/154 |
| 3,851,685 | 12/1974 | Ahrweiler et al. | 100/93 RP |
| 3,965,769 | 6/1976 | Ahrweiler et al. | 100/151 |
| 3,993,426 | 11/1976 | Ahrweiler et al. | 425/371 |
| 4,468,188 | 8/1984 | Gerhardt | 425/371 |
| 4,645,632 | 2/1987 | Böttger et al. | 100/154 |
| 5,112,431 | 5/1992 | Gerhardt et al. | 156/583.5 |
| 5,182,986 | 2/1993 | Bielfeldt | 100/151 |
| 5,253,571 | 10/1993 | Bielfeldt et al. | 100/41 |
| 5,323,696 | 6/1994 | Bielfeldt et al. | 100/154 |
| 5,333,541 | 8/1994 | Bielfeldt et al. | 100/41 |

FOREIGN PATENT DOCUMENTS

| | | |
|---|---|---|
| 2545366 | 4/1977 | Germany . |
| 7525935 | 4/1980 | Germany . |
| 3133817 | 3/1983 | Germany . |
| 3914105 | 10/1990 | Germany . |

*Primary Examiner*—Stephen F. Gerrity
*Attorney, Agent, or Firm*—Foley & Lardner

[57] ABSTRACT

A continuously operating press for the production of particle boards, fiber boards and similar wood boards and plastic boards, has flexible endless steel belts which transmit the pressing pressure, pull the material to be pressed through the press, are guided over driving drums and reversing drums around an upper and a lower press beam and are supported with an adjustable press nip against press/heating platens on the press beams via rolling supporting elements which accompany their revolution and are guided with their axes transverse to the direction of belt running. The lower and/or the upper press/heating platen is vertically adjustable to set the press nip by a plurality of cylinder-piston arrangements arranged in rows transversely to the longitudinal axis of the press. The pressure pistons of the cylinder-piston arrangements each have a multi-surface support to give flexible multi-point introduction of force relative to the elastically deformable press/heating platens and spherical deformation of the press/heating platen over its length and width can be introduced by different forces in the cylinders across the width and/or the length by virtue of the multi-surface support of the cylinder-piston arrangements.

16 Claims, 5 Drawing Sheets

CONTINUOUSLY OPERATING PRESS FOR THE PRODUCTION OF PARTICLE BOARDS, FIBER BOARDS OR SIMILAR WOOD BOARDS AND PLASTIC BOARDS

BACKGROUND OF THE INVENTION

The invention relates to a continuously operating press for the production of particle boards, fiber boards or similar wood boards and plastic boards.

Designs for such continuously operating presses have been disclosed by German Offenlegungsschrift/Patent 2,157,746, 2,545,366, 3,133,817, 3,914,105 and German Utility Model 7,525,935.

To control the procedure, all continuously operating presses must precisely reproduce the process sequence, as is known from the known intermittent-operation press technology for the production of particle boards, MDF boards (Medium Density Fiber) or OSB boards (Oriented Strand Boards). For this purpose, it is necessary that all continuously operating presses should be capable of deforming at least one press/heating platen, either the upper or the lower one, spherically in the longitudinal and transverse directions in such a way that relatively large distances or nip clearances between the upper and the lower heated press platen can be set longitudinally in accordance with the different thicknesses of the boards to be produced, their moisture content and the resulting steel-belt speeds or, in other words, production rates, to give the necessary uniform steam distribution or degasification along the pressing zone. The same applies to a transverse deformation of the press/heating platen, this being essentially a convex action on the pressing stock, this having a favorable effect for example on the transverse tensile strength and, in association with this, also on the consumption of adhesive.

This object is achieved to greater or lesser degrees by all existing continuously operating presses, that is to say with a greater or lesser time requirement for a change in the process parameters for this.

In the case of the presses disclosed in German Patents 3,133,817 and 3,914,105, the spacings between the frames are chosen in such a way that the heating platens in conjunction with the slab are relatively thick. In the case of the press in accordance with German Patent 3,133,817, a counter heating facility is integrated into the slabs and, in accordance with German Patent 3,914,105, into the heating platens. By means of these counter heating facilities, the heating platens can be deformed concavely, in a plane-parallel manner or convexly. When there is a change in production, from a thick board (38 mm) to a thin board (8 mm) for example, the convex transverse deformation and the temperature profile must be changed. Due to the combined thickness of the press/heating platen and the slab with its counter heating facility, the system operates relatively slowly. In order to accelerate the transverse deformation processes somewhat, the forces of the outer cylinders are changed with respect to the pressing cylinders arranged in the center. Due to the thickness of the heating and slab system, on-line adjustment, i.e. in the course of a change effected without interrupting production, by means of this change in the force in the cylinders is possible to only a limited extent, up to about 40%. Extreme changeovers from thick- to thin-board production are therefore only accomplished, if at all, by interrupting maintenance shifts—which can last for several hours—because the thermal changes require this time.

In the case of the presses from German Offenlegungsschrift 2,157,746, German Offenlegungsschrift 2,545,366 and German Utility Model 7,525,935, each frame is assigned a multiplicity of pressing cylinders, allowing any desired spherical deformation of the press/heating platen to be carried out in the longitudinal and transverse directions. To this extent, such a press meets the requirement for an on-line adjustment in a change effected without interrupting operation. However, the outlay in terms of constructing the machinery is considerable since the concept, which uses a relatively thin press/heating platen, requires a very narrow spacing between the frames, which means a large number of frames and hence also a large number of hydraulic actuating cylinders i.e. almost a carpet of bottom pistons. This concept involves relatively high production costs.

The requirement made of modern systems, however, is for just-in-time production, i.e. flexible manufacture according to orders. This means that a continuously operating press must be capable of carrying out a change without interrupting operation. The continuously operating presses known on the market at present can only do this to a limited extent or, in some cases, not at all.

The continuously operating presses constructed by the applicant hitherto operate on the principle of a lateral-arrangement top-piston press for the longitudinal influencing of the upper heating platen so as to deform the press along the pressing zone and with the additional arrangement of multi-pot/hydraulic short-stroke cylinders which are installed centrally underneath the lower heating platen for the purpose of transverse deformation. The principle of the press frame of this continuously operating press is known from Patent Application German Offenlegungsschrift 4,017,791. This embodiment of a continuously operating press is capable of setting the respective spherical deformation of the press/heating platen in the longitudinal and transverse directions in an on-line process in which the change in production is carried out without interrupting operation. However, the outlay in terms of constructing the machinery and the resulting production costs for this kind of continuously operating press is considerable, particularly due to the design of the press ram system with the associated arrangements of the laterally attached top pistons.

The use and development of continuously operating presses has led in recent years to continuously rising production rates, leading to press lengths in the region of 40 m and more. This was associated with a dramatic increase in the number of hydraulic actuators along the pressing zone to set the pressing-force profile longitudinally and transversely, forming a so-called hydraulic carpet of cylinder-pistons. The same applies to the press/heating platens and to the operating wear in the region of rolling support. An increase in the length of the press brings with it an increase in the speed of the steel belts and thus in the rolling speeds of the rolling supporting elements (rolling rods or rolling chains), thereby shortening the life expectancy of the wear-dependent functional elements. All this leads to an increased susceptibility to faults, with the result that there is the inevitable requirement in such complex plant systems that the hydraulic actuators should be rapidly accessible for maintenance and/or repair in the case of a fault and that wearing elements (heating-platen or rolling-contact plate systems) should be rapidly replaceable.

This is not readily possible in the case of the two first-mentioned press-frame arrangements in accordance with German Patent 3,133,817 and German Patent 2,157,746 since the window-frame construction or beam construction prevents direct access from the side. Replacement or removal of the hydraulic actuators at the side, e.g. changing the hydraulic sealing elements, is associated with a considerable investment of time, that is with fairly long interruptions to production. The situation is even more critical as regards the replacement of the functional members subject to wear, that is the press/heating platens. Here, the steel belts must be taken apart in order to replace these heating platen/rolling-contact systems at the end, either at the entry or exit end. This replacement can require up to several weeks and obviously entails not only a massive financial loss for the operator but also possibly a poor reputation resulting from overlong delivery times.

SUMMARY OF THE INVENTION

The object on which the invention is based is to provide a continuously operating press with which the overall production costs for the press are lower and the requisite concave, convex and spherical deformations of the press/heating platens for a change in production without interrupting operations can be carried out in a few seconds on-line.

A part of the object consists in improving the continuously operating press in such a way that functional elements important for maintenance, repair and, in the case of faults, for maintaining production are easily accessible and can thus be removed and reinstalled rapidly, ensuring high availability of the continuously operating press for the operator.

The solution according to the invention allows flexible deformation of the heating platens in the longitudinal and/or transverse directions in a controlled manner in a few seconds from flat to convex or concave or even concave/spherical on-line by virtue of the multi-surface support of the heating platens in a manner similar to a carpet of bottom pistons. Each individual surface support according to the invention may be compared to each individual hydraulic actuator of the previous type of carpet of bottom pistons of this kind. Since, in the solution according to the invention, four surface supports are assigned to each hydraulic actuator or pressure piston, the number of hydraulic actuators and the number of hydraulic control units to be installed for these is reduced by a factor of four, allowing a considerable simplification in the system of hydraulic cylinder-piston arrangements and controls and a dramatic reduction in the production costs.

Also of advantage here are in particular the supporting crossmembers assigned to the pressure pistons, these supporting crossmembers taking over the function in the design of a supporting beam, for example a press ram, the division into a plurality of simple supporting crossmembers ensuring a highly flexible supporting structure—a precondition for spherical deformation.

By means of the features of the invention, it is furthermore ensured that the replacement of wearing parts and repair can be carried out very rapidly with free access to the interior of the pressing zone and press space by releasing and pivoting out the tiebars. Another advantage is that repair or replacement of individual parts of the hydraulic cylinder-piston arrangements can be carried out without difficulties since the favorable construction of the press beams and their connection by the tiebars makes possible free access to the individual parts and even allows the removal and insertion of an entire transverse row m of cylinder-piston arrangements between the tiebars. Also advantageous is the simple-to-produce and inexpensive construction of the individual beams and their suspension or arrangement on the four I-section girders.

Additional objects, features and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENTS

Figure 1:
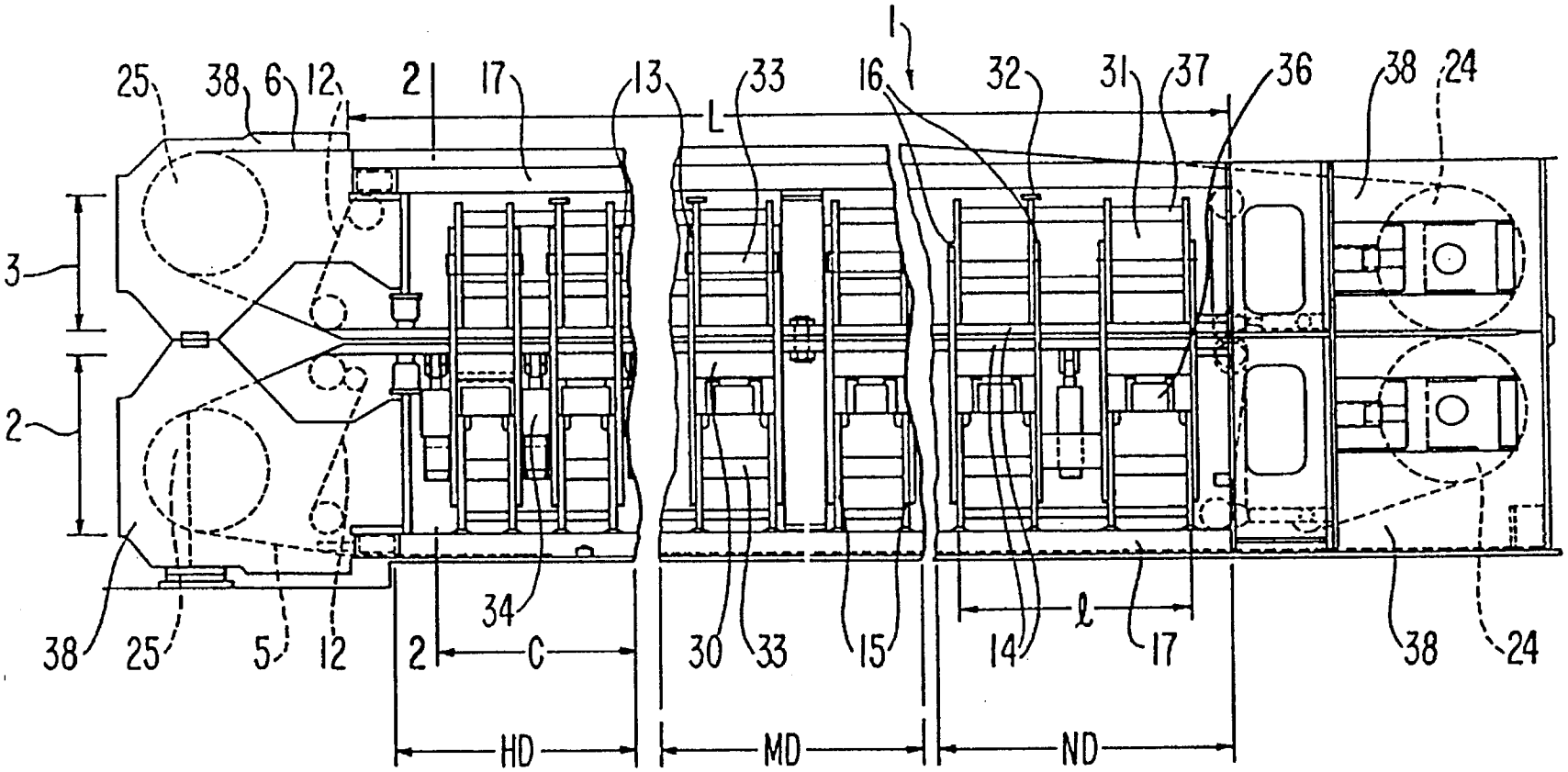
FIG. 1 shows the continuously operating press according to the invention in side view.
Figure 2:
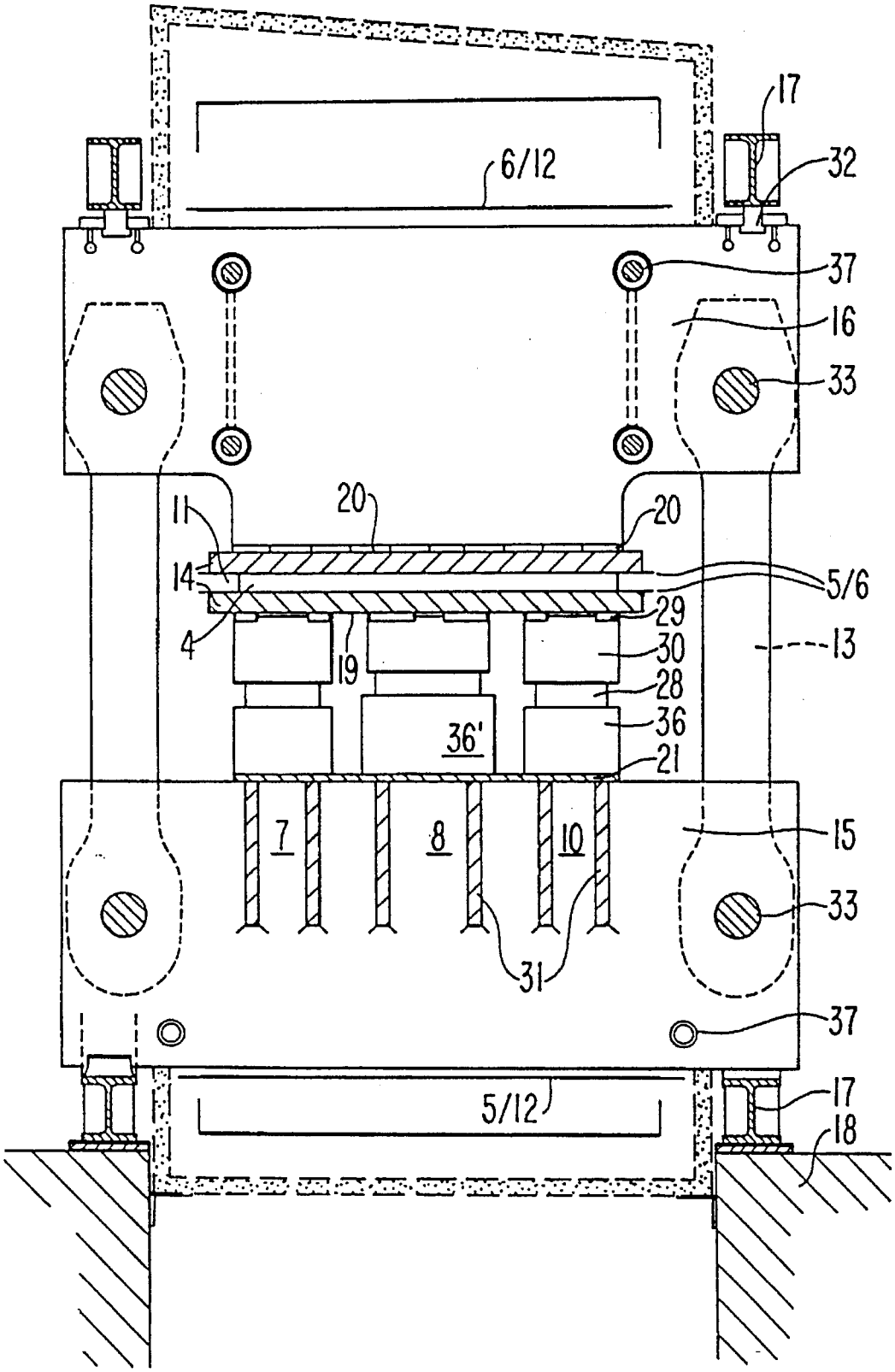
FIG. 2 shows the continuously operating press in accordance with FIG. 1 in front view and in a section 2—2.
Figure 3:
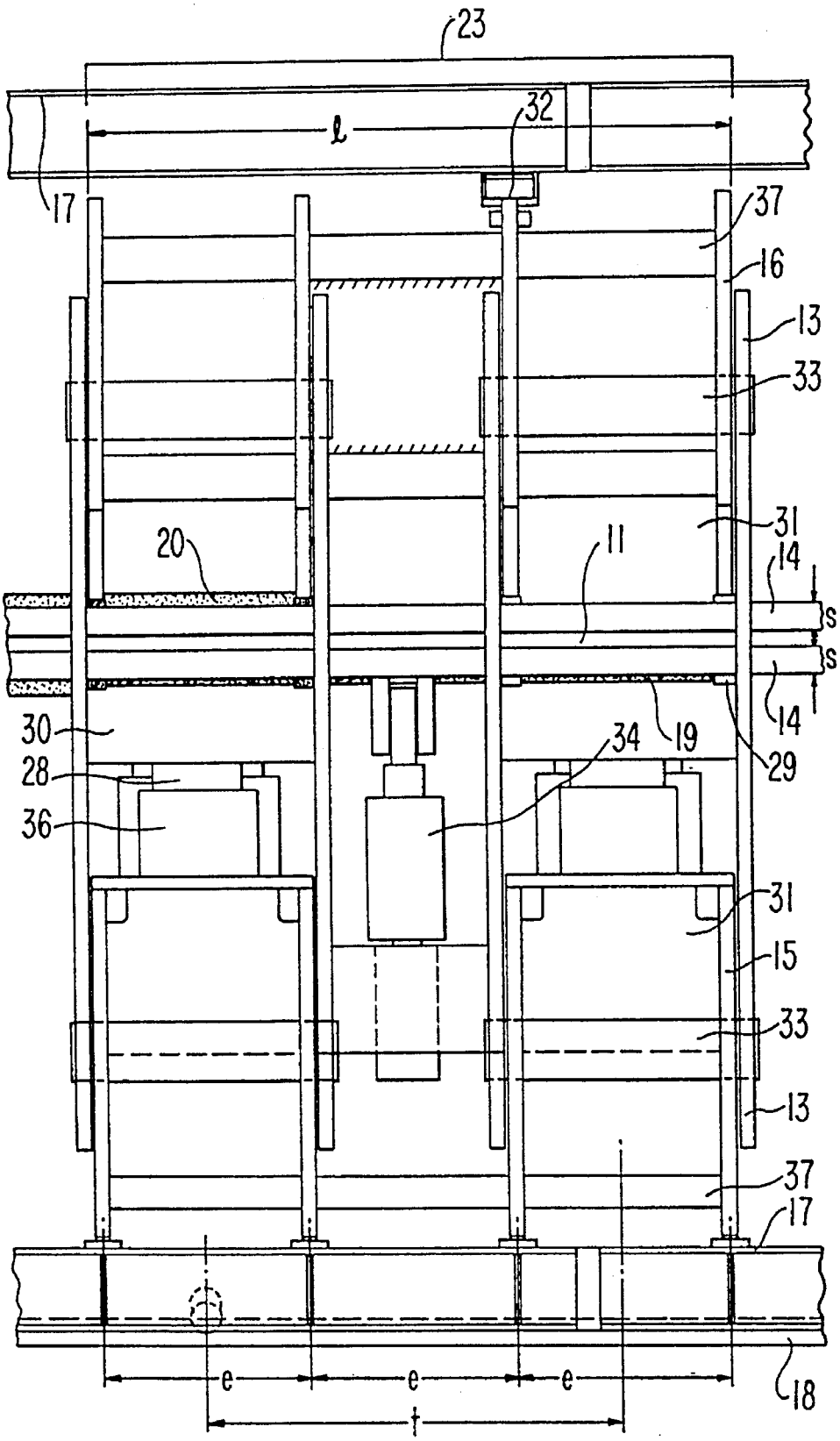
FIG. 3 shows a part C of FIG. 1, FIGS. 4 to 6 each show a plan view of part of the support for the heating platen by means of the cylinder-piston arrangements

According to FIGS. 1 to 3, the main parts of the continuously operating press according to the invention are the upper and lower press beams 3 and 2 and the ties 13, which connect them positively. The tiebars 13 can be released rapidly by means of the push-in pins 33. Side plates 38 are attached to the ends of the press beams 2 and 3 and serve for the anchorage and support in bearings of the driving drums 24, the reversing drums 25 and the entry systems for the rolling rods 12. The press beams 2 and 3 consist simply of web plates 15 and 16 and ribs 31 connecting them. Four web plates 15 and 16 in each case are connected by means of ties 37 to form each individual beam 23 and, having been arranged in line and having had the press/heating platens 14 mounted on them, these form the length L of the press beams 2 and 3.

FIG. 1 further shows how the reversing drums 25 form the entry gap and how the rolling rods 12 guided around the press beams 2 and 3 with the steel belts 5 and 6 are supported against the press/heating platens 14. This means that the circulating rolling rods 12, as an example of a rolling support, are arranged so as to roll between the press/heating platens 14 and the steel belts 5 and 6. The pressing stock 4 is drawn through the press nip 11 by the steel belts 5 and 6—driven by the driving drums 24—and compressed into boards.

As can furthermore be seen from FIG. 1, the support spacings e of the web plates 15 and 16 are shorter in the front, high-pressure region HP and become longer as the force profile decreases. As a general rule for dimensioning the support spacings e in the high-pressure region HP to the exit of the continuously operating press in the low-pressure region LP, the following can expediently be applied:

e=about 500 mm to about 1000

In the hydraulic cylinder-piston arrangements 7, 8, (9) and 10, the pressure pistons 28 are arranged underneath the press/heating platen 14 and are supported on supporting plates 21 of the lower press beam 2. They could just as well be used as top pistons under the upper press beam 3. However, for thermal reasons the bottom-piston arrangement is preferred so as to minimize heating of the hydraulic oil by the rising heat. The pressure pistons 28 are supported on the lower press beam 2. In order to permit spherical deformation in the transverse direction, for example convex deformation, a higher force is employed in the case of the central cylinder 36' than in the case of the lateral cylinders 36. This means that a different hydraulic pressure is fed in to that at the outer cylinders 36. In the case of the preferred convex setting, the central cylinder can be provided with a larger piston area.

The advantageous design and arrangement of the cylinder-piston arrangements 7, 8, (9) and 10 can be seen from FIGS. 2 to 7. The cylinders 36 and 36' and the pressure pistons 28 each have supporting crossmembers 30 and these elements transmit the centrally acting hydraulic forces from the pressure pistons 28 to the supporting crossmembers 30 and, via supporting surfaces 26, to the lower press/heating platen 14. These supporting surfaces 26, which are simultaneously designed as highly thermally insulated supporting bodies 29 or supporting strips 27 (thermal insulation components) resistant to high pressure, (i.e., the supporting bodies, or supporting strips are composed of a material which is resistant to high pressure and provides high-temperature insulation, the material being resistant to temperatures of over 220° C.) are arranged at the four corners of the supporting crossmembers 30 in such a way that the support spacings x of the supporting surfaces 26 correspond to the support spacings e of the web plates 15 and 16. It is of advantage here that four supporting surfaces 26 take effect per support spacing e (=frame spacing) and supporting crossmember 30. This would correspond to 12 cylinders 36 if three cylinders 36 were employed across the width k of the heating platen, given a normal width k of about 2200 mm. In the case of greater widths k, four hydraulic cylinder-piston arrangements 7, 8, 9 and 10 would be employed. In this case, the supporting surfaces would correspond to 16 individual cylinders distributed between two webs 19 and 16 in each case. Since the cylinder-piston arrangements 7, 8, 9 and 10 are each supported on two lower web plates 15 of the lower press beam 2, this gives a ratio of the hydraulic cylinder-piston arrangements 7, 8, 9 and 10 actually installed to the supporting surfaces 26 of 1:4. This means that the number of hydraulic cylinder-piston arrangements 7, 8, 9 and 10 could thus be reduced considerably for a significantly larger range of action.

By virtue of this larger range of action of the hydraulic cylinder-piston arrangements 7, 8, 9 and 10, the geometry of the lower press/heating platen 14 can be controlled hydraulically to give a convex, spherical or concave shape. Each modified geometrical position comprised within the longitudinal and transverse deformation can be set on-line within a few seconds. Owing to the supporting crossmember 30 the upper and lower press/heating platen 14 can be made relatively thin, that is to say the lower press/heating platen 14 can be deformed spherically, both longitudinally and transversely, within the elastically permissible range by hydraulic-mechanical means to match the technological requirements. The hydraulic and mechanical structure for influencing the heating platen has thereby been considerably simplified and the number of functional elements significantly reduced, and a considerable reduction in the cost of the apparatus has thus been achieved.

The tiebars 13 are arranged to the outside of the web plates 15 and 16 of the press beams 2 and 3. This makes it possible to withdraw the entire unit comprising the hydraulic cylinder-piston arrangements 7, 8, (9) and 10 (three or four cylinders) together with the supporting crossmembers 30 sideways on the supporting plate 21 between the tiebars 13 for servicing (for example to change the seals). The pretensioning forces on the steel belts 5 and 6 between the entry and exit drum systems are taken as a compressive force by four I-section girders the lower press beam 2 resting on the lower I-section girder 17, which is anchored in the foundation 18. The web-plate structure of press beam 3 can be suspended on the upper I-section girder 17 by means of screwed joints 32.

For the lateral replacement of important functional elements subject to functional wear, for example the press/heating platens 14 or the rolling-contact plates 35, some of the tiebars 13 are removed, at least on one side, that is they are pushed sideways off the push-in pins 33. The suspension of the upper press beam 3 makes it possible to gain access to the press 1 from the side virtually over the entire pressing zone without taking the steel belts 5 and 6 apart.

To prevent or stem the flow of heat from the press/heating platens 14 into the press beams 2 and 3, insulating layers or panels 19 and 20 are mounted on the rear side of the press/heating platens 14. In order to be able to deform the press/heating platens 14 elastically—on-line—in the longitudinal and transverse directions by means of hydraulic cylinder-piston arrangements 7, 8, 9 and 10, the press/heating platens 14 must not be too thick. Depending on the pressing-force profile along the pressing zone and on the support spacings e, the thickness of the heating platens is preferably in a range of from 75 to 150 mm.

The number of cylinders 36 from the high-pressure region HP to the low-pressure region LP remains the same notwithstanding, three cylinders 36 being sufficient in the case of a continuously operating press with a standard width 2200 mm for example. In the case of wider presses up to about 3000 mm, four cylinders 36 are employed. To achieve the pressing-force profile, cylinders 36 with a greater force, that is a larger cylinder diameter are therefore used in the front, high-pressure region HP, while cylinders 36 with a lower force and a smaller cylinder area 22 are used in the medium-pressure region MP and low-pressure region LP, thus matching the pressing-force profile. To allow the servohydraulics to be used to control the position longitudinally in relation to the pressing zone between the upper and lower press/heating platen 14, the return cylinders 34 shown are necessary.

FIGS. 4 to 7 show the possible arrangement and design of the cylinder-piston arrangements 7, 8, 9 and 10 for a heating-platen width k=2200 mm and of the cylinder-piston arrangements 7, 8, 9 and 10 for a heating-platen width k=3000 mm.

Figure 4:
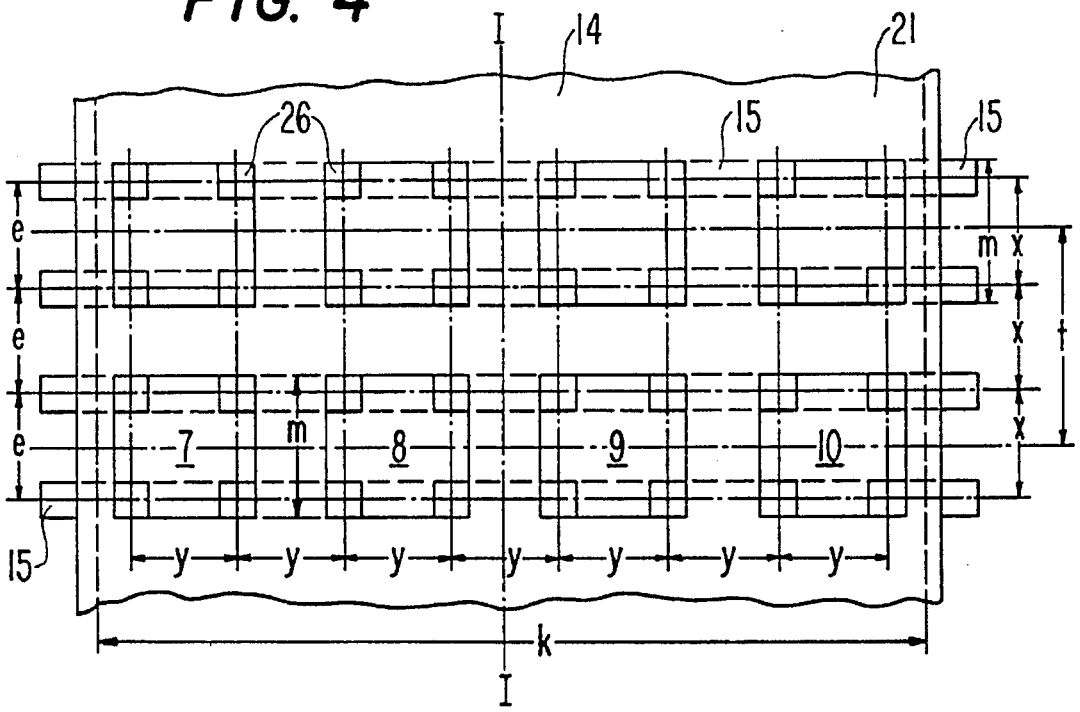

FIG. 4 shows a heating-platen support for a row in the lower press/heating platen 14 with four cylinder-piston arrangements 7, 8, 9 and 10. Here, t denotes the support spacing of the cylinders 36 or cylinder-piston arrangements 7, 8, 9 and 10 and x denotes the support spacing of the supporting surfaces 26 or supporting bodies 29 along the length L of the press beams. In the example, the support spacing y of the supporting bodies 29 from and relative to one another is equal to the support spacing x but, depending on the dimensioning of the supporting crossmembers 30, can also be different, thus y, $y_1$ and $y_2$ in accordance with FIG. 5.

Figure 5:
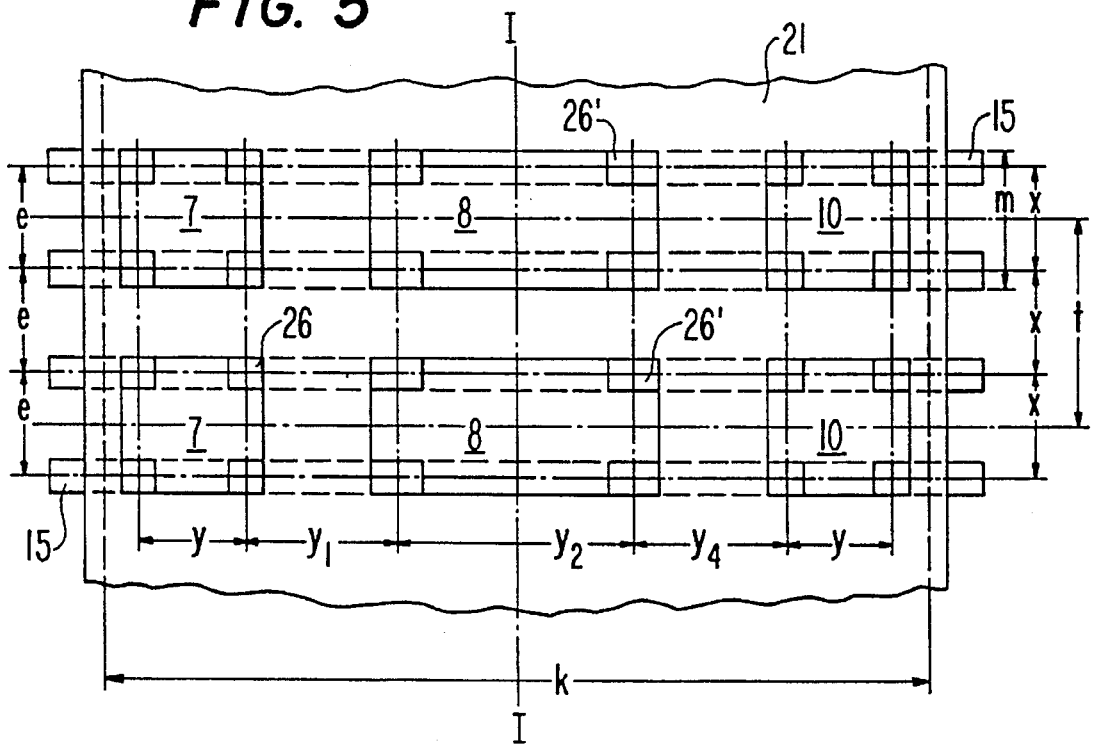
Figure 6:
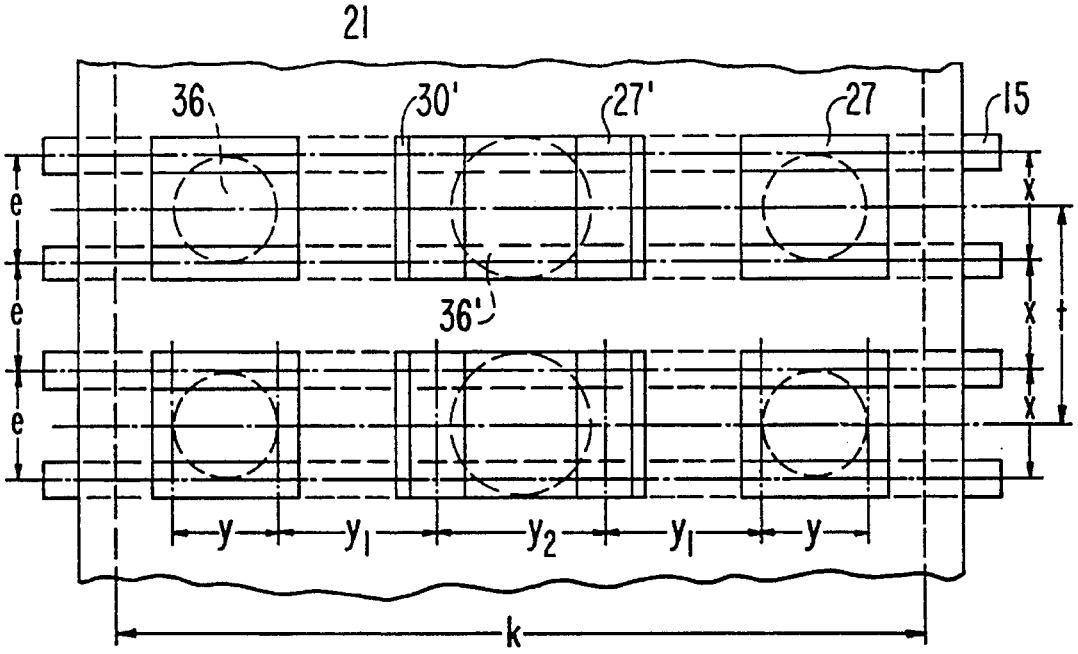

As can be seen from FIGS. 4, 5 and 6, the supporting bodies 29 or supporting surfaces 26 always act perpendicularly and congruently on the front faces of the web plates 15 and the center distance e between two web plates 15 is thus equal to the center distance x between two supporting surfaces 26/supporting bodies 29, i.e. the width of the supporting crossmembers 30 and the arrangement of the supporting bodies 29/supporting surfaces 26 thereon changes with the center distance e between the web plates 15.

FIG. 5 shows an alternative arrangement of the supporting surfaces 26 with supporting strips 27. From this arrangement, it can be seen that the central supporting crossmembers 30 can also have a rectangular format and the support spacings y of the supporting strips 27 are thus also altered.

Figure 7:
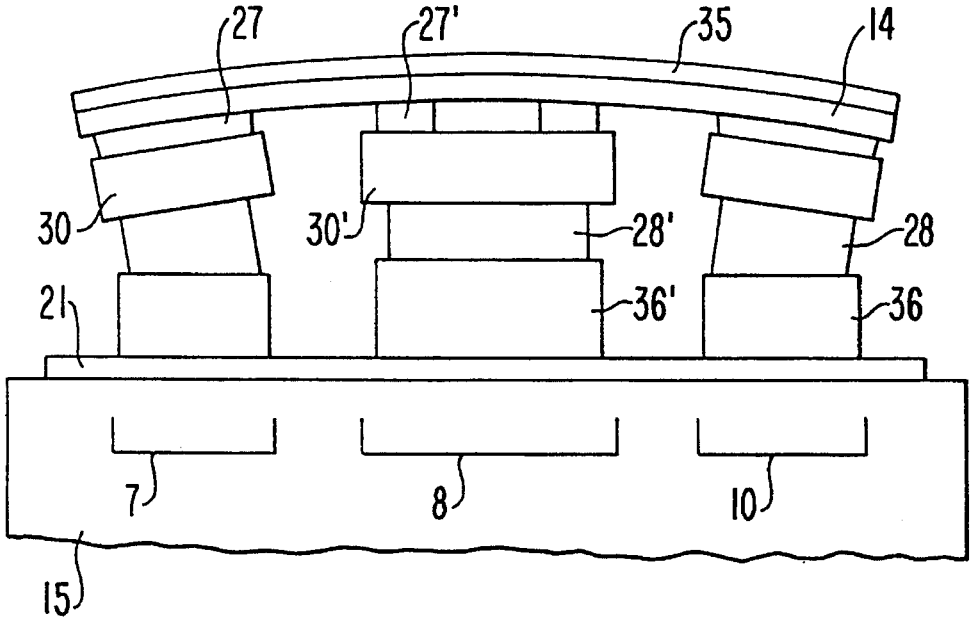
FIG. 7 shows a front view in accordance with FIG. 6.

FIGS. 6 and 7 show another alternative for multi-surface support in accordance with the invention. The hydraulic forces of the pressure pistons 28, 28' are introduced into the press/heating platen 14 via the supporting strips 27. In this pressure piston, different hydraulic forces bring about a spherical deformation of the press/heating platen 14 with corresponding bending deformations (bending lines) longitudinally and transversely with respect to the pressing zone. By virtue of the non-positive engagement of the supporting strips 27, the vertical axis of the pressure piston follows these elastic bending deformations in a spherically oriented angular deflection. The guide and hydraulic sealing of the pressure piston 28 are designed with corresponding degrees of freedom in such a way that they automatically follow the variable angular position of the piston.

Hardened rolling-contact plates 35 are attached to the press/heating platens 14 as a running surface for the rolling rods 12. The press/heating platens 14 and the hardened rolling-contact plates 35 attached to them are divided along a pressing zone into replaceable individual segments with lengths of about 3 m to 12 m to allow lateral removal.

It can also be seen from FIGS. 4 to 7 that the cylinder areas 22 of the central cylinders 36' are of larger configuration than those of the outer cylinders 36.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A continuously operating press for the production of particle boards, fiber boards and similar wood boards and plastic boards, comprising:

driving drums and reversing drums;

an upper press beam and a lower press beam;

an upper press/heating platen and a lower press/heating platen;

a plurality of rolling supporting elements, each having a longitudinal axis; and flexible endless steel belts which transmit a pressing pressure, pull material to be pressed through the press, are guided over the driving drums and reversing drums around the upper and lower press beams, and are supported with an adjustable press nip against the press/heating platens on the press beams via the plurality of rolling supporting elements which accompany the belts in revolution and are guided with their longitudinal axes transverse to a running direction of the belts, at least one of the lower and the upper press/heating platens being vertically adjustable to set the press nip by a plurality of cylinder-piston arrangements arranged in rows transversely to a longitudinal axis of the press, wherein pressure pistons of the cylinder-piston arrangements each have a multi-surface support to give flexible multi-point introduction of force relative to the press/heating platens, which are elastically deformable and wherein spherical deformation of one press/heating platen over its length and width can be introduced by different forces in the cylinders across at least one of the width and the length by virtue of the multi-surface support of the cylinder-piston arrangements.

2. The continuously operating press as claimed in claim 1, wherein the multi-surface support for each pressure piston is selected from the group of four supporting surfaces and two supporting strips.

3. The continuously operating press as claimed in claim 2, wherein, when two supporting strips are used per pressure piston in a row, the supporting strips are arranged with their longitudinal rectangle sides transverse to a pressing zone in the case of outer cylinder-piston arrangements, and rotated through 90° so as to be parallel to the pressing zone in the case of central cylinder-piston arrangements.

4. The continuously operating press as claimed in claim 1, wherein individual supporting surfaces of the multi-surface support for the pressure pistons are supporting structures selected from the group consisting of supporting bodies and supporting strips, and are arranged on supporting crossmembers between the pressure pistons and the press/heating platen.

5. The continuously operating press as claimed in claim 4, wherein the press beams include web plates, and wherein longitudinal spacings of the supporting structures relative to one another correspond to support spacings of the web plates.

6. A continuously operating press, as claimed in claim 4, wherein the press beams comprise individual beams of different lengths which can be connected to one another and are made up of web plates and ribs connecting the latter, upper individual beams being suspended on two I-section girders which take the pretensioning forces of the steel belts and which represent the length of the press, while the lower press beam rests on two I-section girders anchored in a foundation, wherein the press beams are connected positively by replaceable tiebars that can be pivoted out, and wherein the cylinder-piston arrangements of one row are arranged between the tiebars and the press/heating platens together with the supporting crossmembers and supporting structures in such a way that they can be introduced into and removed from a pressing zone after the release of some of the tiebars.

7. The continuously operating press as claimed in claim 6, wherein support spacing of the web plates from each other decreases from a high pressure area to a low pressure area, and amounts to approximately 500 mm to approximately 1000 mm.

8. The continuously operating press as claimed in claim 4, wherein the press/heating platens have a thickness of 75 to 150 mm depending on the spacing of the supporting structures relative to one another, and are each separated from the press beams by a thermal insulation.

9. The continuously operating press as claimed in claim 4, wherein the supporting structures are composed of a material which is resistant to high pressure and provides high-temperature insulation, the material being resistant to temperatures of over 220° C.

10. The continuously operating press as claimed in claim 1, wherein the press beams are connected by tiebars, and wherein one row of cylinder-piston arrangements extends in the longitudinal direction of the press in a space between two tiebars.

11. The continuously operating press as claimed in claim 1, wherein the press is a bottom-piston press, and only the lower press/heating platen is vertically adjustable.

12. The continuously operating press as claimed in claim 1, wherein a guide and a piston sealing the pressure piston have a sufficient degree of freedom to allow a vertical axis of the pressure pistons to adapt automatically to the spherical bending deformation of the press/heating platen.

13. The continuously operating press as claimed in claim 1, wherein at least one of the lower and the upper press/heating platens is supported by three cylinder-piston arrangements per row in the case of a width of the press/heating platen of about 2200 mm and by four cylinder-piston arrangements per row in the case of a width of the press/heating platen of about 3000 mm, in each case on supporting plates of the press beams and in a manner which allows them to be raised and lowered.

14. The continuously operating press as claimed in claim 1, wherein the cylinder-piston arrangements include decreasing cylinder areas from a high-pressure region to a low-pressure region, a central cylinder-piston arrangement being provided with a larger cylinder area than outer cylinder-piston arrangements.

15. The continuously operating press as claimed in claim 1, wherein hardened rolling-contact plates are attached to the press/heating platens as a running surface for the rolling rods, and wherein the press/heating platens and the hardened rolling-contact plates attached to them are divided along a pressing zone into replaceable individual segments with lengths of about 3 m to 12 m to allow lateral removal.

16. The continuously operating press as claimed in claim 1, wherein the cylinder-piston arrangements include decreasing cylinder areas from a high-pressure region to a low-pressure region, two central cylinder-piston arrangements of a row being provided with a larger cylinder area than outer cylinder-piston arrangements.

* * * * *